US009340056B2

(12) United States Patent
Giacomello

(10) Patent No.: US 9,340,056 B2
(45) Date of Patent: May 17, 2016

(54) APPARATUSES AND METHOD FOR DECORATING OBJECTS

(75) Inventor: Ivana Giacomello, Località Costeggiola (IT)

(73) Assignee: DECORAL SYSTEM USA CORP., Coral Springs, FL (US)

( * ) Notice: Subject to any disclaimer, the term of this patent is extended or adjusted under 35 U.S.C. 154(b) by 976 days.

(21) Appl. No.: 12/515,980

(22) PCT Filed: Nov. 20, 2007

(86) PCT No.: PCT/IB2007/003560

§ 371 (c)(1),
(2), (4) Date: Aug. 27, 2009

(87) PCT Pub. No.: WO2008/062277

PCT Pub. Date: May 29, 2008

(65) Prior Publication Data

US 2010/0054718 A1 Mar. 4, 2010

(30) Foreign Application Priority Data

Nov. 22, 2006 (IT) ..... MO2006A0389

(51) Int. Cl.
*B41M 5/035* (2006.01)

(52) U.S. Cl.
CPC ..... *B41M 5/0358* (2013.01)

(58) Field of Classification Search
CPC ..... B41M 5/0358; B41M 5/035; A21B 2/00; B44C 1/17; F21V 7/00; F26B 3/30
USPC ..... 219/405; 392/407, 411, 417, 422–435, 392/416
See application file for complete search history.

(56) References Cited

U.S. PATENT DOCUMENTS

| | | | | |
|---|---|---|---|---|
| 3,193,663 | A * | 7/1965 | Tadeusz et al. | 219/405 |
| 3,371,187 | A * | 2/1968 | Volker | 392/423 |
| 3,502,844 | A * | 3/1970 | Lawes et al. | 392/418 |
| 4,662,966 | A | 5/1987 | Sumi et al. | |
| 4,752,061 | A * | 6/1988 | Dalton et al. | 266/87 |
| 5,196,676 | A * | 3/1993 | Hallahan | 219/388 |
| 5,202,080 | A | 4/1993 | Bannick et al. | |
| 5,446,825 | A * | 8/1995 | Moslehi et al. | 392/416 |
| 5,504,831 | A * | 4/1996 | Sandhu et al. | 392/418 |
| 5,762,713 | A * | 6/1998 | Paranjpe | 118/725 |
| 6,016,383 | A * | 1/2000 | Gronet et al. | 392/416 |
| 6,242,717 | B1 * | 6/2001 | Sanderson | 219/405 |
| 6,759,632 | B2 * | 7/2004 | Ducret et al. | 219/390 |
| 6,935,329 | B2 * | 8/2005 | Han et al. | 126/41 R |
| 2003/0217999 | A1 | 11/2003 | Jones | |
| 2005/0011614 | A1 | 1/2005 | Benetton | |
| 2005/0173400 | A1 * | 8/2005 | Cavada et al. | 219/411 |
| 2008/0037965 | A1 * | 2/2008 | De Luca | 392/416 |

FOREIGN PATENT DOCUMENTS

| | | |
|---|---|---|
| EP | 0 224 320 A2 | 6/1987 |
| EP | 1 055 524 A1 | 11/2000 |

(Continued)

*Primary Examiner* — Eric Stapleton
(74) *Attorney, Agent, or Firm* — Laubscher, Spendlove & Laubscher, P.C.

(57) ABSTRACT

An apparatus for decorating includes a kiln provided with a heating chamber for receiving the objects and a carriage for transferring the objects from a more distant position from the chamber to a position nearer to the chamber. The carriage includes a resting arrangement for restingly receiving the objects and configured to serve as a bottom of the heating chamber in the nearer position.

9 Claims, 11 Drawing Sheets

(56) References Cited

FOREIGN PATENT DOCUMENTS

| | | | | | |
|---|---|---|---|---|---|
| EP | 1 464 679 | A2 | | 10/2004 | |
| JP | 11-135449 | | * | 5/1999 | ..... H01L 21/26 |
| RU | 2 056 604 | C1 | | 3/1996 | |
| WO | 9638281 | A1 | | 12/1996 | |
| WO | WO 2006 037506 | A1 | | 4/2006 | |

* cited by examiner

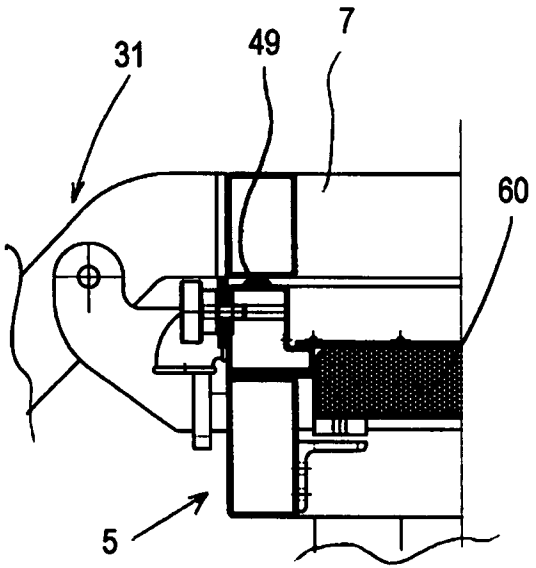
Fig. 11
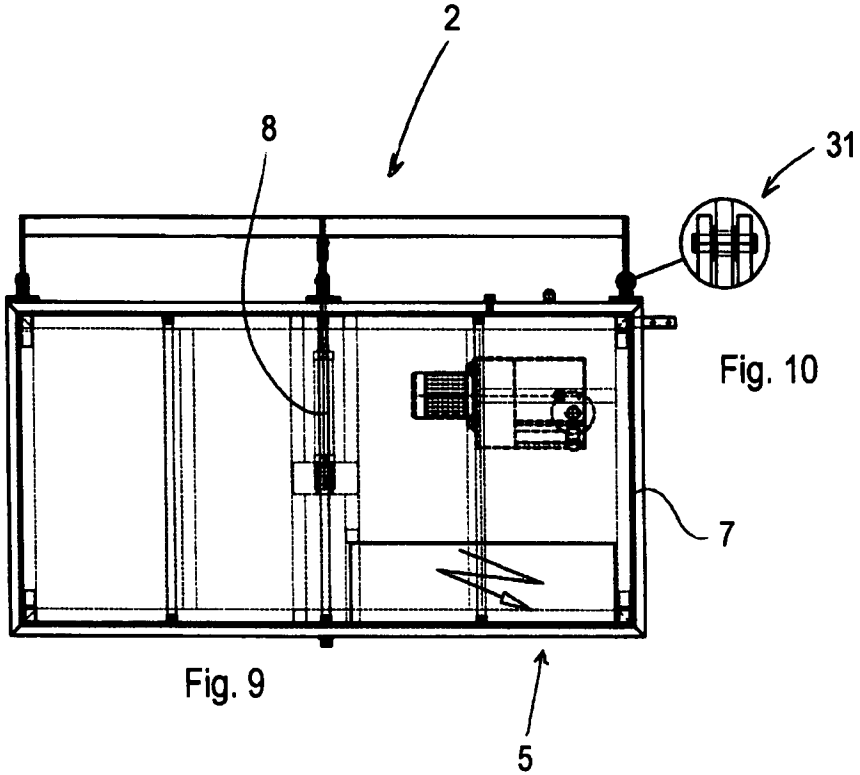
Fig. 10
Fig. 9

46
47
XXII
XXII 48
46
47
47

46

48
47
46

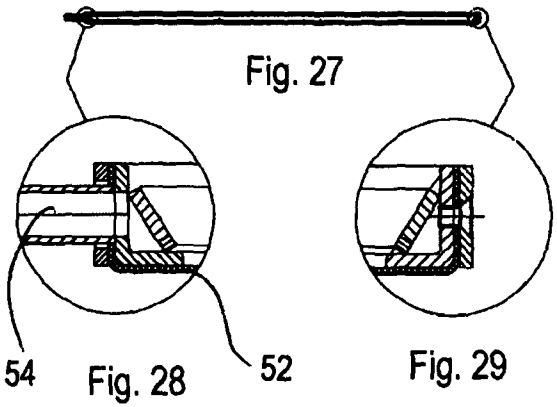
Fig. 27
52
54
Fig. 28
Fig. 29
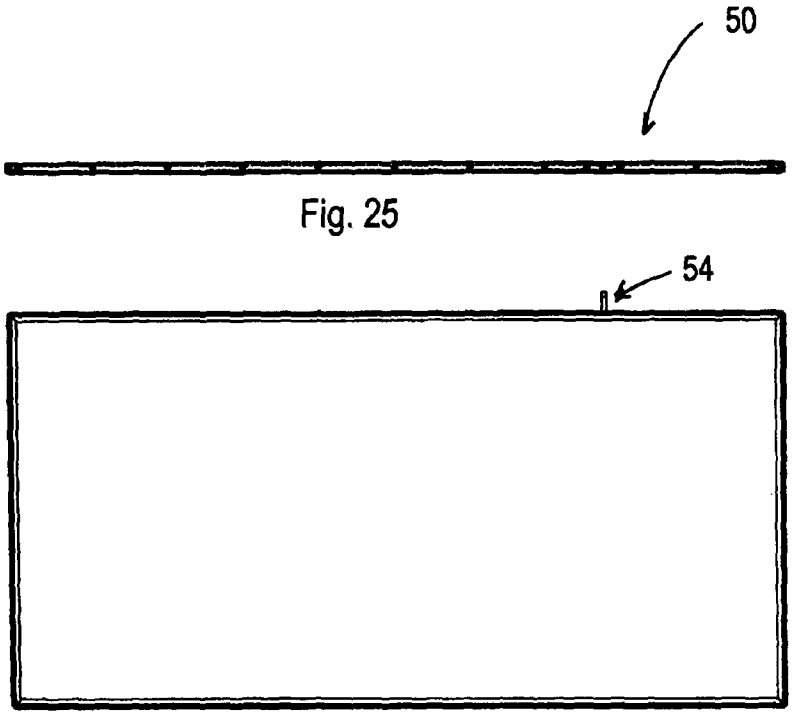
50
54
Fig. 25
Fig. 26

APPARATUSES AND METHOD FOR DECORATING OBJECTS

The invention relates to apparatuses and a method per decorating objects, for example section bars, sheet metal, etc. The apparatuses and the methods according to the invention enable any type of pattern to be transferred to the objects, for example decorations that reproduce the veining of wood or marble, or other types of decoration. The section bars that are decorated with the apparatuses and the method according to the invention can be used in building, for example for constructing doors or windows, in furnishings, in design or the like.

Apparatuses are known for decorating section bars by means of sublimation of an ink, comprising a kiln provided with gas burners, arranged for receiving internally the section bars to be decorated, and a conveying system for introducing and extracting the section bars into and from the kiln.

The conveying system comprises rails along which a carriage can run that is introduced inside the kiln by passing through an opening of the latter. The carriage is substantially formed by a framework provided with parallel supporting bars arranged transversely to the rails and spaced apart from one another. The supporting bars act as a resting plane for the section bars, i.e. the section bars are positioned on the carriage so as to be arranged transversely to the supporting bars. Thus portions of section bars spaced from one another rest on respective supporting bars.

At the ends of the framework suction ports are provided that are connected to pumps for the vacuum.

Each section bar is enclosed in a tubular casing having open ends, made with a film made of plastics having, on a side facing the section bar, a sublimable printed decoration. The section bar is positioned on the carriage and the suction ports are inserted in the open ends of the tubular casing, such that each suction port closes the corresponding end. By means of the pumps, the suction ports suck the air from inside the tubular casing, so as to make the film adhere to the external surface of the section bar.

The carriage is then transferred inside the kiln so that the section bars remain inside the latter for a preset period of time that is sufficient for reaching a temperature at which the decoration sublimates, transferring itself to the surface of the section bar. The gas burners enable a flow of hot air to be generated that is then directed by a ventilation system to the section bars to be decorated.

When the decoration has been transferred to the section bars the carriage is extracted from the kiln and it is possible to extract the section bars that have just been decorated from the respective tubular enclosures.

Alternatively to the gas burners, infrared lamps can be provided for generating the heat that is necessary for sublimating the decorations. Ventilation devices are provided for making the hot air circulate inside the kiln.

A drawback of known devices is that they do not enable the energy to be used efficiently that is consumed by the kilns for the sublimation of the decorations. In particular, the infrared lamps emit radiation that is not directed in an optimum manner towards the objects to be decorated. The objects can in this way have zones that are more exposed to radiation than others, which may give rise to unevenness in the transferring of the decorations. Further, part of the heat contained inside the kiln is often dispersed through the opening and the walls of the kiln.

Apparatuses are further known that comprise a carriage provided with a resting bench on which the objects to be decorated are loaded. The resting bench is provided with a plurality of suction holes connected to a suction pump for sucking the air. On the objects to be decorated, located on the resting bench, a film of air-impermeable material is superimposed that supports a sublimable ink decoration. By means of the air suction pump the air interposed between the film, the objects and the bench is sucked through the suction holes so that the film adheres to the surfaces of the objects. At this point, the objects are transferred inside a kiln to obtain the transfer by sublimation of the decorations from the film to the objects.

If objects have to be decorated that are easily subject to deformation, for example hollow objects or sheet metal that is not flat and is provided with recesses, stiff or semi-stiff supporting elements can be provided, for example made of rubber, wood, aluminium, steel, etc. The supporting elements are housed in the recesses of the objects such as to oppose the thrust exerted by the film on the objects through the effect of the air suction.

A drawback of these apparatuses is that for decorating without damaging particularly delicate objects the aforesaid supporting elements must be provided. When the objects are rather complex, for example are provided with recesses having complex shapes, it is very difficult and expensive to provide suitably shaped supporting elements. This is made even more complicated if it is necessary to decorate objects that each time have different geometrical shapes.

An object of the invention is to improve the known apparatuses and methods for decorating objects.

Another object of the invention is to provide an apparatus that is able to exploit with great efficiency the energy consumed during operation of the kiln, significantly reducing dissipation of energy.

A further object of the invention is to provide an apparatus in which thermal radiation generated by a kiln is directed optimally towards the objects to be decorated so as to make the distribution of temperature on the objects more even and to enable correct sublimation of the decorations.

A still further object of the invention is to provide a method and an apparatus that is able to decorate simply and cheaply objects that are particularly delicate and have complex shapes, for example shaped sheet metal, without it being necessary to use stiff or semi-stiff supporting elements. In particular, it is possible to decorate objects, avoiding having to provide complex supporting elements each time having shapes that vary each time according to the shape of the objects to be decorated.

In a first aspect of the invention, there is provided an apparatus for decorating objects, comprising kiln means provided with a heating chamber for receiving said objects, carriage means for transferring said objects from a more distant position from said chamber to a nearer position to said chamber, characterised in that said carriage means comprises resting means for restingly receiving said objects, said resting means being so shaped as to act as a bottom of said heating chamber in said nearer position.

Owing to this aspect of the invention, it is possible to obtain an apparatus that enables the energy consumed to be used more efficiently during operation of the kiln. In particular, the resting means enables the chamber to be shut so as to contain the heat better inside the chamber. The resting means, by acting as a bottom to the chamber, bounds a chamber having a reduced volume compared with known apparatuses, so as to limit energy dispersion and the energy needed to heat the entire chamber.

In a second aspect of the invention, there is provided an apparatus for decorating objects, comprising a kiln for generating thermal radiation so as to transfer a sublimable decoration on said objects, a carriage for introducing said objects into, and extracting said objects from, said kiln, wherein it comprises a reflecting element for directing onto said objects said thermal radiation inside said kiln.

Owing to this aspect of the invention, it is possible to obtain an apparatus that enables the radiation generated, for example by infrared lamps, to be directed effectively towards the objects to be decorated. The reflecting element enables the distribution of the radiation to be improved, especially if several objects have to be decorated simultaneously that are positioned on the carriage.

In fact, the reflecting element enables a part of the thermal radiation to be directed to the objects that would not otherwise hit the objects.

In an embodiment, the reflecting element is removably connected to the carriage. In this case the reflecting element can be removed from the carriage if an object has to be decorated that has dimensions such as to occupy a substantial part of the carriage and which substantially does not leave zones of the carriage uncovered.

In a third aspect of the invention, there is provided an apparatus for decorating a surface of an object by means of a sheet having a sublimable decoration, comprising a sucking device for sucking air between said surface and said sheet, wherein it further comprises a deformable membrane acting on a further surface of said object to oppose the pressure exerted by said sheet against said object, said further surface being intended to remain free of decorations.

In a fourth aspect of the invention, there is provided a method for decorating an object, comprising arranging said object on a membrane, covering a surface of said object with a sheet supporting a sublimable decoration, sucking air between said sheet and said object so that said sheet adheres to said object, wherein during said sucking said membrane is deformed so as to exert pressure on a further surface of said object that remains free of decorations during said decorating.

Owing to the third and fourth aspect of the invention, it is possible to decorate particularly delicate objects and which have complex shapes, for example shaped sheet metal, preventing the objects being deformed through the effect of the thrusts generated by the sheet. In particular the membrane, through the effect of the suction of air, exert pressure on the further surface of the object so as to oppose the thrusts of the sheet that could otherwise cause deformation of the object.

The invention will be better understood and actuated with reference to the attached drawings that illustrate some embodiments thereof by way of non-limiting example, in which:

FIG. 9 is a top view of a supporting carriage;

FIG. 10 shows an enlarged detail of FIG. 9;

FIG. 11 shows another enlarged detail of the supporting carriage of FIG. 9;

FIG. 25 is a view of a further portion of supporting carriage;

FIG. 26 is a top view of the further portion of supporting carriage in FIG. 25;

FIG. 27 is a further view of the further portion of supporting carriage in FIG. 25;

FIG. 28 is an enlarged detail of the further portion of supporting carriage in FIG. 27;

FIG. 29 is a further enlarged detail of the further portion of supporting carriage in FIG. 27.

Figure 2:
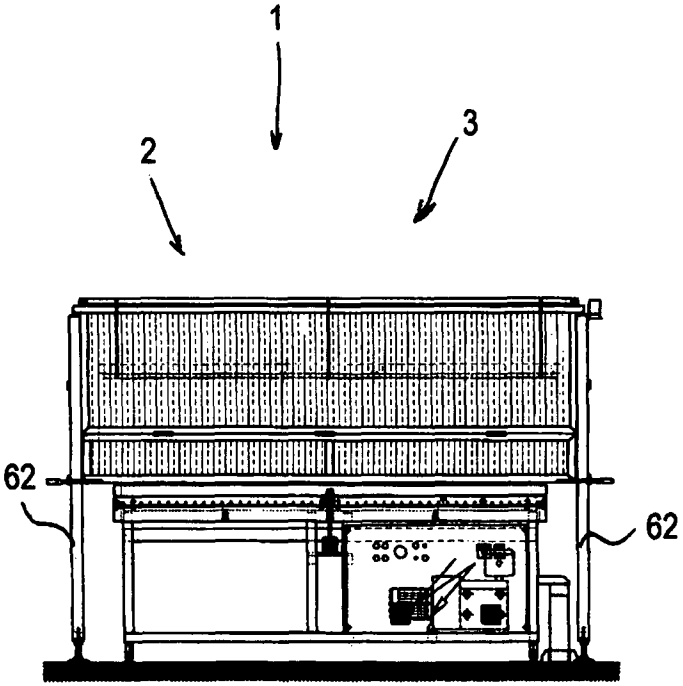
FIG. 2 is a front view of the apparatus in FIG. 1.
Figure 1:
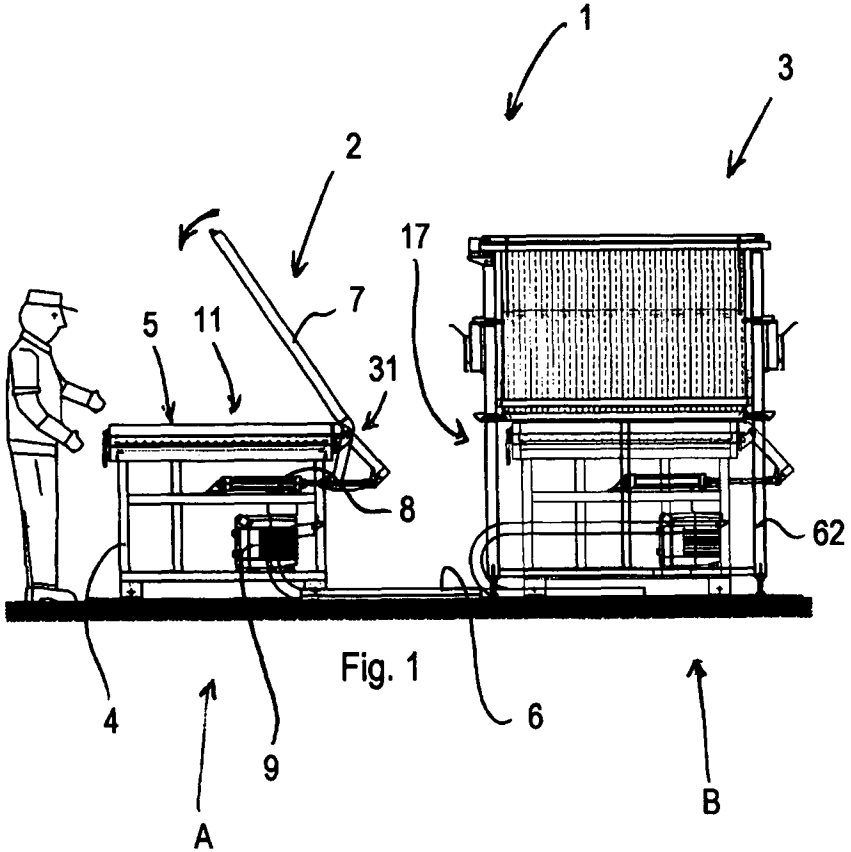
FIG. 1 is a side view of a first embodiment of an apparatus for decorating objects.
Figure 3:
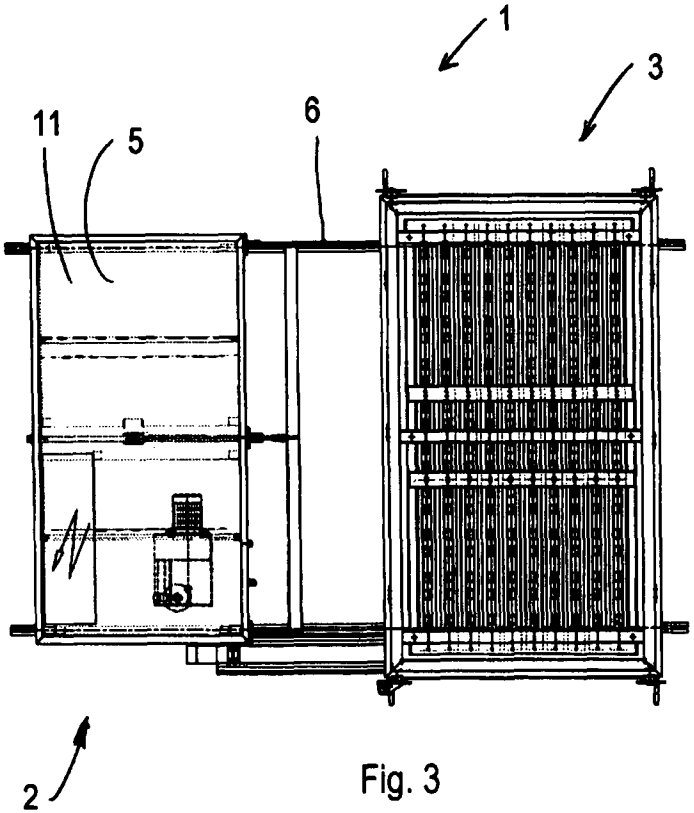
FIG. 3 is a top view of the apparatus in FIG. 1.
Figure 6:
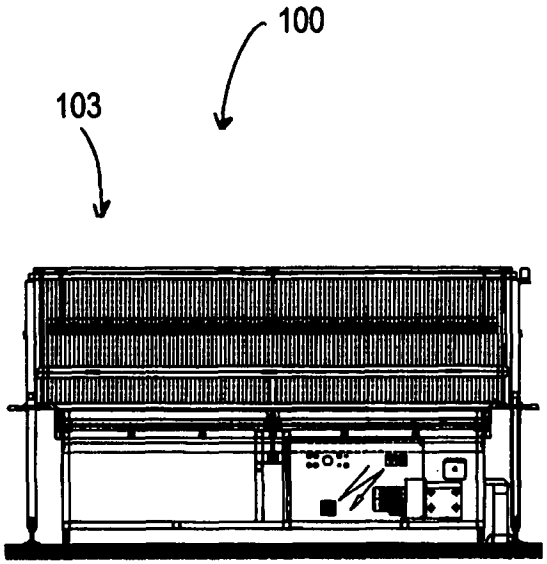
FIG. 6 is a front view of the apparatus in FIG. 5.

A first embodiment of an apparatus 1 for decorating objects by means of sublimable ink decorations, shown in FIGS. 1 to 3, comprises a supporting carriage 2 on which the objects are positioned that have to be decorated and a kiln 3 that receives internally the objects to be processed and is supported by vertical bars 62.

The supporting carriage 2 comprises a structure 4 to which an air-suction pump 9 is connected the function of which will be disclosed below in greater detail. To the structure 4 a supporting frame 5 is connected above that defines a resting plane 11 on which the objects to be decorated are positioned. The supporting carriage 2 is runnable along tracks of a first position A, outside the kiln 3, to a second position B, inside the kiln 3. The supporting carriage 2 is introduced into, and extracted from the kiln 3 through an opening 17 defined between two vertical bars 62.

The supporting carriage 2 is provided with a closing frame 7 connected by means of hinges 31 to the supporting frame 5, as shown better in FIGS. 10 and 11. The closing frame 7 can be moved by a pneumatic or hydraulic cylinder 8. The closing frame 7 is rotated and spaced from the supporting frame 5 to enable the objects to be decorated to be positioned on the latter, after which the closing frame 7 is rotated towards the supporting frame 5. In this way, the objects are interposed between the supporting frame 5 and the closing frame 7.

On the supporting frame 5 seals 49 are provided that restingly receive the closing frame 7.

Figure 4:
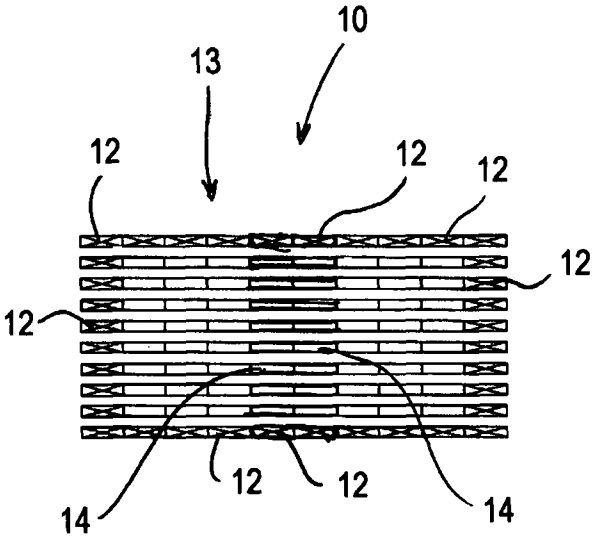
FIG. 4 is a schematic view of a heating arrangement with which the apparatus shown in FIGS. 1 to 3 is provided.

The kiln 3 is provided with an infrared radiation heating system 10. The heating system 10, shown schematically in a plan view in FIG. 4, comprises a plurality of infrared lamps that occupy a region 13 of the kiln 3. The lamps are arranged such that the radiation emitted thereby is distributed substantially evenly on the resting plane 11. In particular, the heating system 10 comprises peripheral lamps 12 arranged along the perimeter of the region 13, and internal lamps 14 arranged inside the region 13. In an embodiment, the peripheral lamps 12 have power equal to 500 W, and the internal lamps 14 have power equal to 250 W.

This configuration of lamps ensures that the same quantity of radiation reaches even the more peripheral zones of the resting plane 11 that hits the more central zones of the resting plane 11, thus ensuring correct sublimation of the decorations.

FIGS. 5 to 8 show a second embodiment of the apparatus for decorating objects, indicated by the reference number 100. The apparatus 100 differs from the previously disclosed apparatus 1 basically because it comprises two supporting carriages that are completely similar to the supporting carriage 2. In particular, a first supporting carriage 18 is provided that is introducible into a kiln 103 through a first opening 20 of the latter. The kiln 103 is structurally similar to the kiln 3. The apparatus 100 further comprises a second supporting carriage 21, introducible in the kiln 103 through a second opening 22 opposite the first opening 20. It is possible to provide a single air-sucking pump unit 23 that is controllable so that it can act on the first supporting carriage 18 or on the second supporting carriage 21 or simultaneously on the first supporting carriage 18 and on the second supporting carriage 21.

The first supporting carriage 18 and the second supporting carriage 21 are introduced into the kiln 103 in an alternating manner. This means that when the first supporting carriage 18 is inside the kiln 103, the second supporting carriage 21 is outside the kiln 103 permit and enable it to be loaded with new objects to be decorated. After the first supporting carriage 18 has been extracted from the kiln 103, the second supporting carriage 21 can be introduced into the kiln 103, and so on.

The kiln 103 is provided with a heating system 110, that, similarly to what, has been disclosed above for the heating system 10, comprises a plurality of infrared lamps suitably positioned on a region 25 of the kiln 103, to distribute effectively and evenly the infrared radiation on the objects to be decorated.

The heating system 110 comprises peripheral lamps 112 arranged along a perimeter of the region 25. Internal lamps 114 are further provided that are arranged inside the perimeter of the region 25.

The peripheral lamps 112 are completely similar to the peripheral lamps 12 and may have power equal to 500 W, whilst the internal lamps 114 are completely similar to the internal lamps 14 and may have power equal to 250 W.

Figure 12:
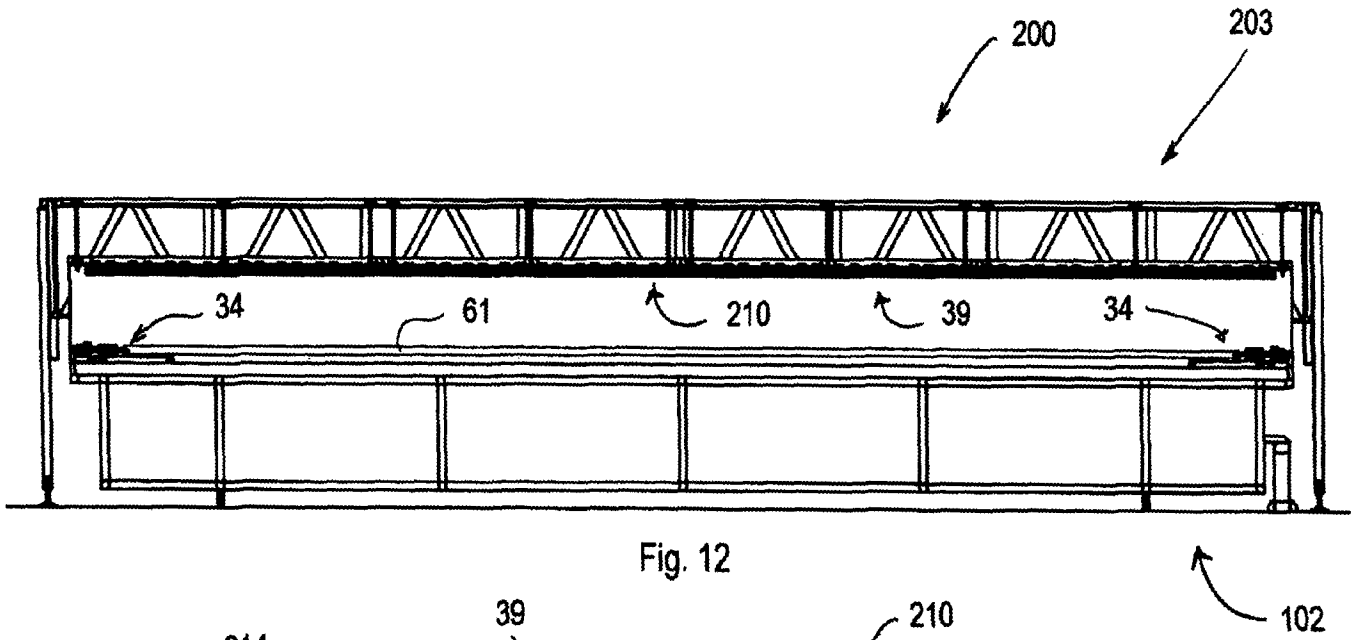
FIG. 12 shows a third embodiment of an apparatus for decorating objects.

An apparatus 200, made according to a third embodiment shown in FIG. 12, comprises a kiln 203, structurally shaped in a similar manner to the kiln 3 and to the kiln 103 disclosed previously, and a supporting carriage 102, partially shaped in a similar manner to the supporting carriage 2 disclosed previously, and having dimensions such as to support very long objects. In particular, the supporting carriage 102 can be dedicated to treating the section bars 61.

The supporting carriage 102 differs from the supporting carriage 2 because it is devoid of the closing frame 7 and comprises a plurality of suction ports 34, better shown in FIGS. 15 to 18, mounted on opposite sides of the supporting carriage 102. Each suction port 34 comprises a head 35 internally provided with a hole for sucking air by means of a pump, and peripherally provided with a seal ring. The head 35 is connected to a hollow bar 36 outside which a locking sleeve 37 is arranged. The locking sleeve 37 can slide coaxially to the bar 36 so as to reach a position in which it surrounds the head 35.

During operation, the section bars 61 are introduced inside a tubular casing that is open at the ends, the tubular casing being made of a transferring support on the internal surface of which sublimable decorations are printed that have to be transferred to the section bars 61. The transferring support is made of a flexible material, for example, a plastic film that is impermeable to air.

Each tubular casing, containing a respective section bar 61, is positioned on the supporting carriage 102. Each of the two open ends of the tubular casing is connected to a suction port 34. In particular, each head 35 is introduced into an open end of a respective tubular casing and the corresponding locking sleeve 37 is sealed on the corresponding head 35, the transferring support being interposed between the locking sleeve 37 and the head 35. In this way, the suction ports 34 are enabled to close open ends of the tubular casing.

Subsequently, through the head 35 the air is sucked that is present inside the tubular casing, so that the latter adheres progressively to the respective section bar. In this way it is possible to transfer successively the decoration through sublimation to the section bar 61.

The procedure disclosed above is repeated for all the section bars 61 that it is desired to load on the supporting carriage 102.

Alternatively, the section bars 61 can be wound in a tubular casing on which the sublimable decorations are printed, which are made, for example, of paper material, and are then introduced into a tubular membrane that is impermeable to air.

In an embodiment, it is possible to provide suction ports 34 only at an end of the supporting carriage 102. In this way, the tubular enclosures have an enclosed end and only one open end from which the air is extracted.

Figure 5:
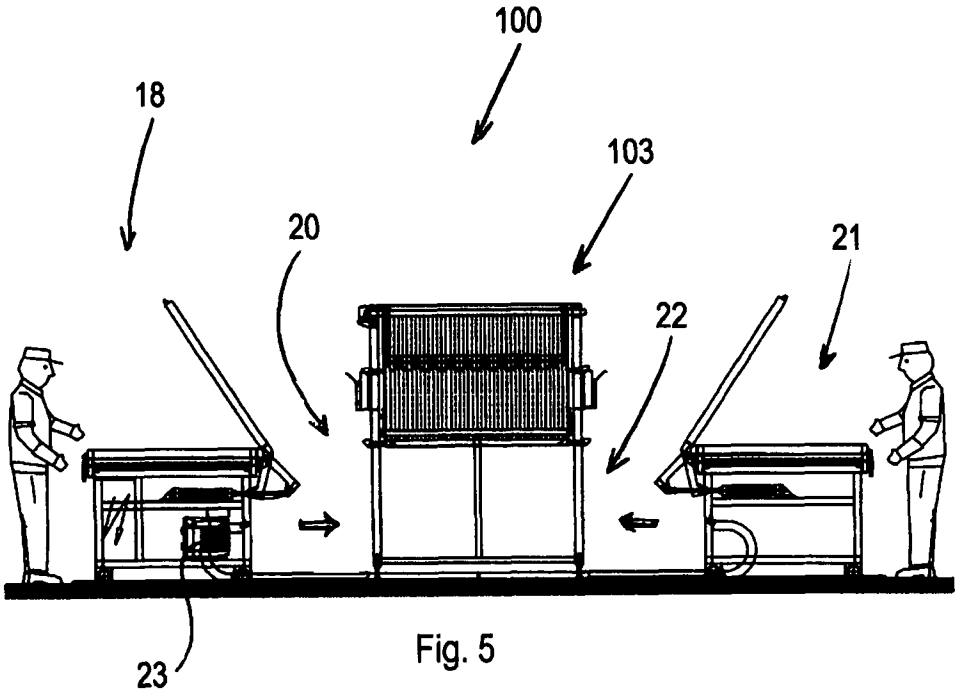
FIG. 5 shows a second embodiment of apparatus for decorating objects.
Figure 8:
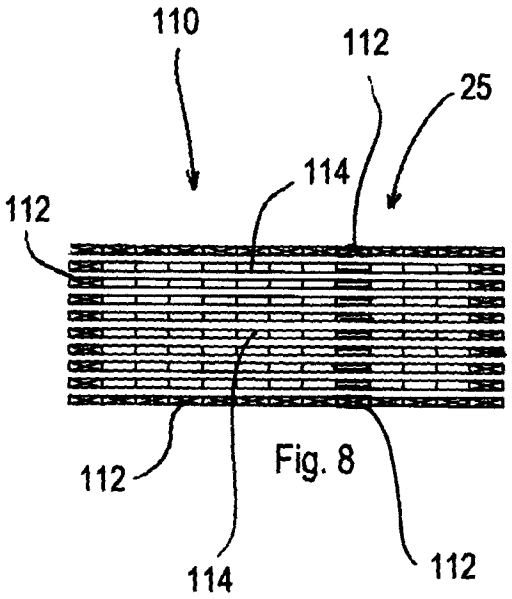
FIG. 8 is a schematic view of a heating arrangement with which the apparatus shown in FIGS. 5 to 7 is provided.
Figure 7:
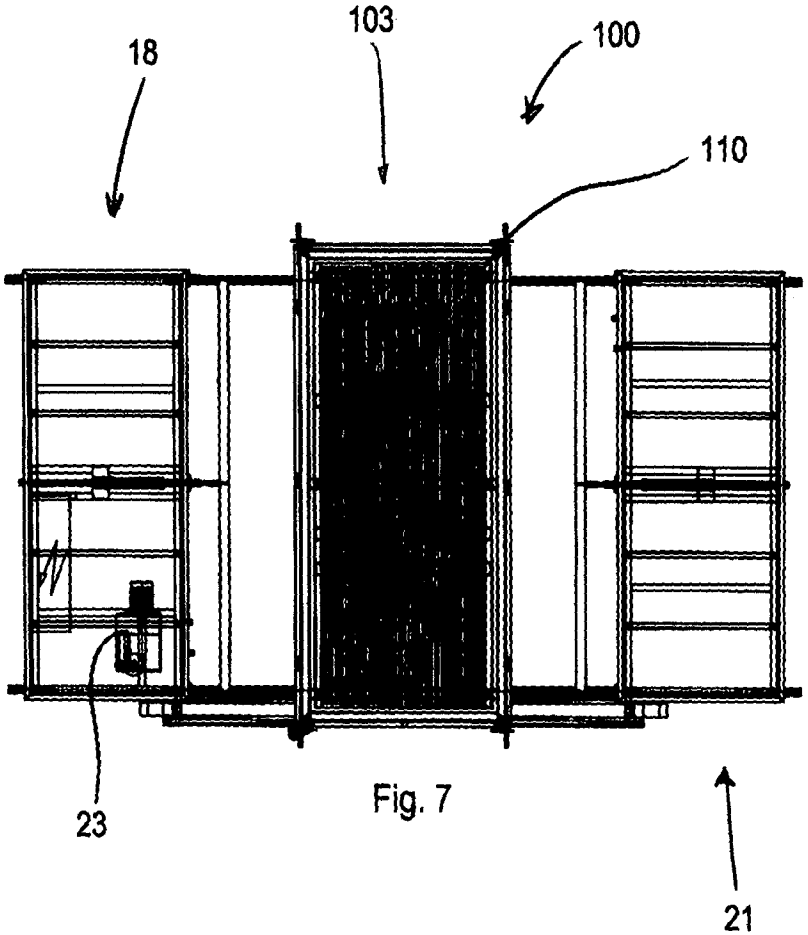
FIG. 7 is a top view of the apparatus in FIG. 5.

In an embodiment that is not shown, the apparatus 200 may comprise two supporting carriages that are introduced inside the kiln in an alternating manner according to a method similar to the one disclosed with reference to the apparatus in FIG. 5. In this case, whilst a first carriage is inside the kiln, a second carriage is prepared, i.e. air is sucked from the tubular enclosures that contain the section bars 61. This enables downtime to be reduced, especially when it is necessary to process very long section bars for which reason a great quantity of air has to be sucked.

When the first carriage has been extracted from the kiln, the second carriage is introduced into the kiln.

The apparatus 200 may comprise temperature sensors for detecting the temperature on the section bars 61 in such a way as to indicate the sublimation process state. For example, when the sensors measure temperatures of about 190-200° C. on the section bars a signal can be generated that indicates that the section bars 61 are ready to be extracted from the kiln.

Figure 13:
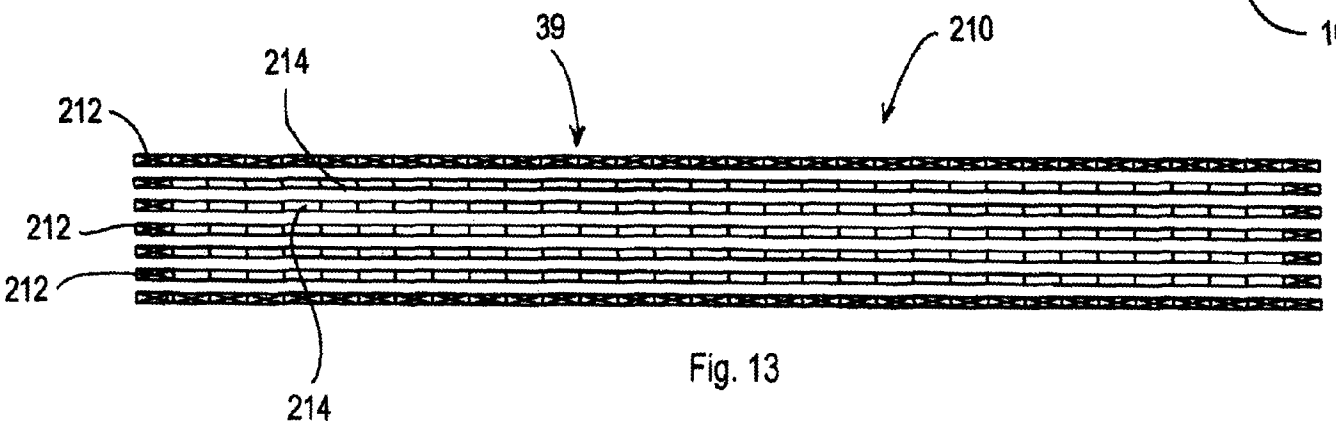
FIG. 13 is a schematic view of a heating arrangement with which the apparatus shown in FIG. 12 is provided.

In FIG. 13 a heating system 210 is shown schematically that is included in the apparatus 200. Similarly to what has been disclosed previously for the heating system 10, also the heating system 210 comprises a plurality of infrared lamps that are suitably positioned on a region 39 of the kiln 203, for distributing effectively and evenly the infrared radiation on the section bars 61 to be decorated. The region 39 has an area that substantially corresponds to the plant view of an area of a chamber of the kiln 203 in which the section bars 61 can be heated.

The heating system 210 comprises peripheral lamps 212, arranged along a closed edge zone of the region 39, and internal lamps 214 positioned inside the edge zone.

The peripheral lamps 212 are completely similar to the peripheral lamps 12 or to the peripheral lamps 112 disclosed previously, and have power equal to 500 W.

The internal lamps 214 are completely similar to the internal lamps 14 or to the previously disclosed internal lamps 114, and have power equal to 250 W.

Figure 14:
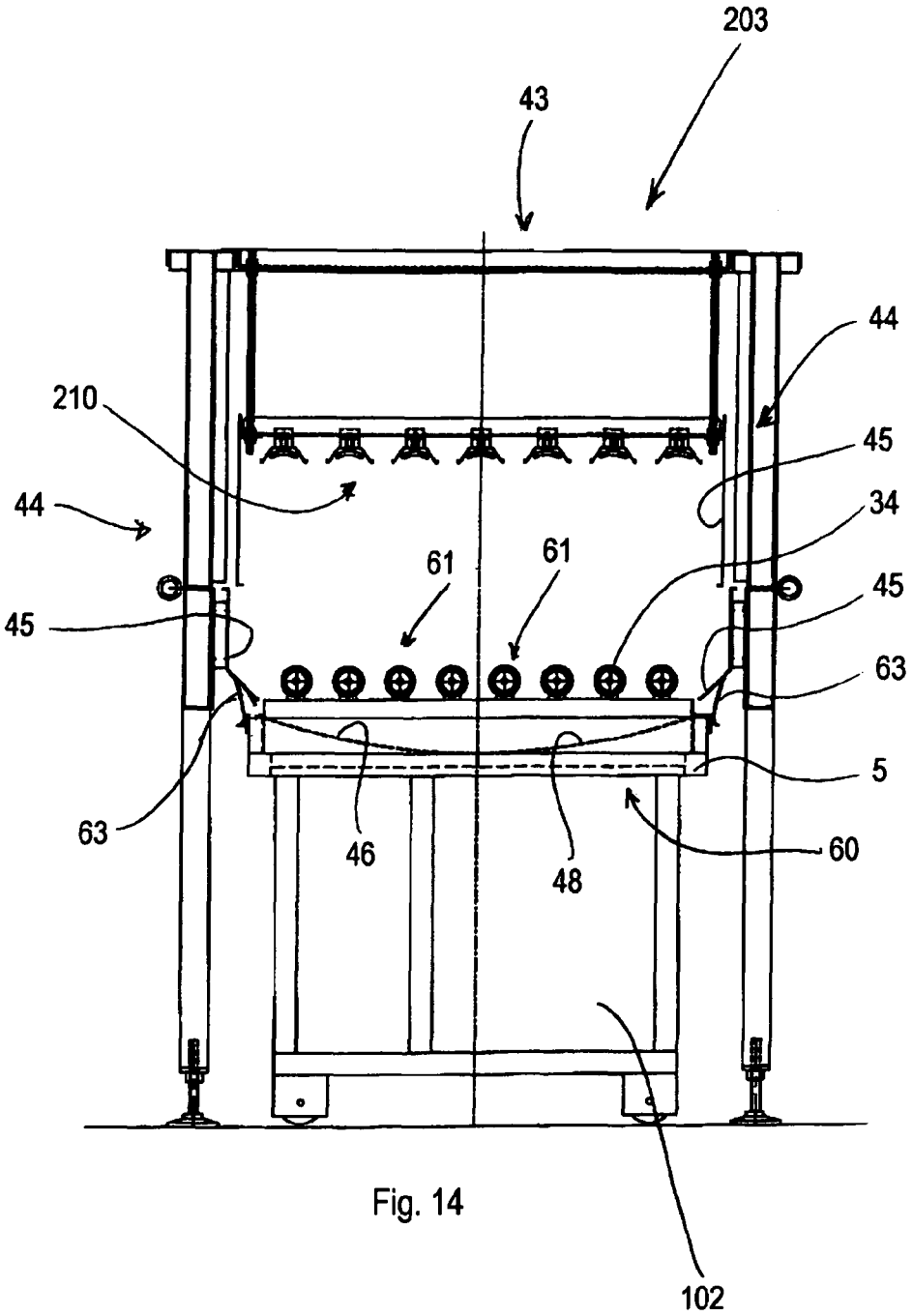
FIG. 14 is a side view of the apparatus in FIG. 12.
Figure 17:
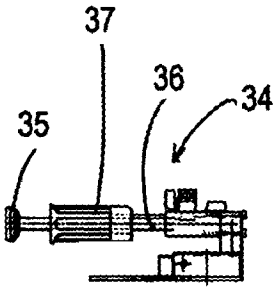
FIG. 17 is a side view of the suction manifolds shown in FIG. 15.
Figure 18:
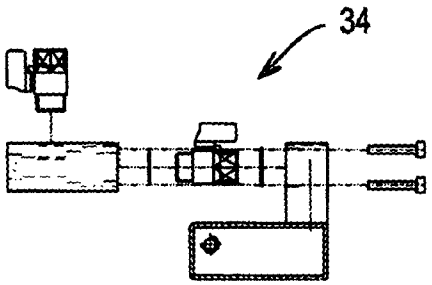
FIG. 18 is an exploded view of a portion of the suction manifolds in FIG. 17.
Figure 15:
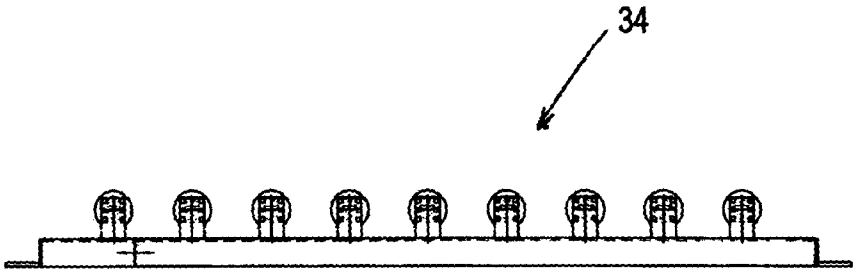
FIG. 15 shows suction manifolds of the apparatus in FIG. 12.
Figure 16:
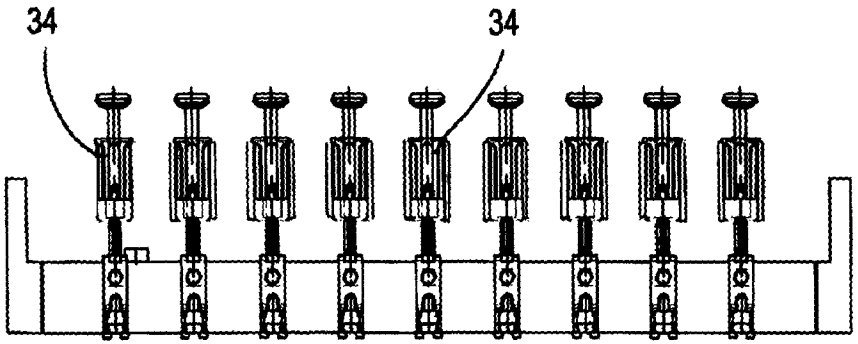
FIG. 16 is a top view of the suction manifolds FIG. 15.
Figures 19, 20, 21, 22:
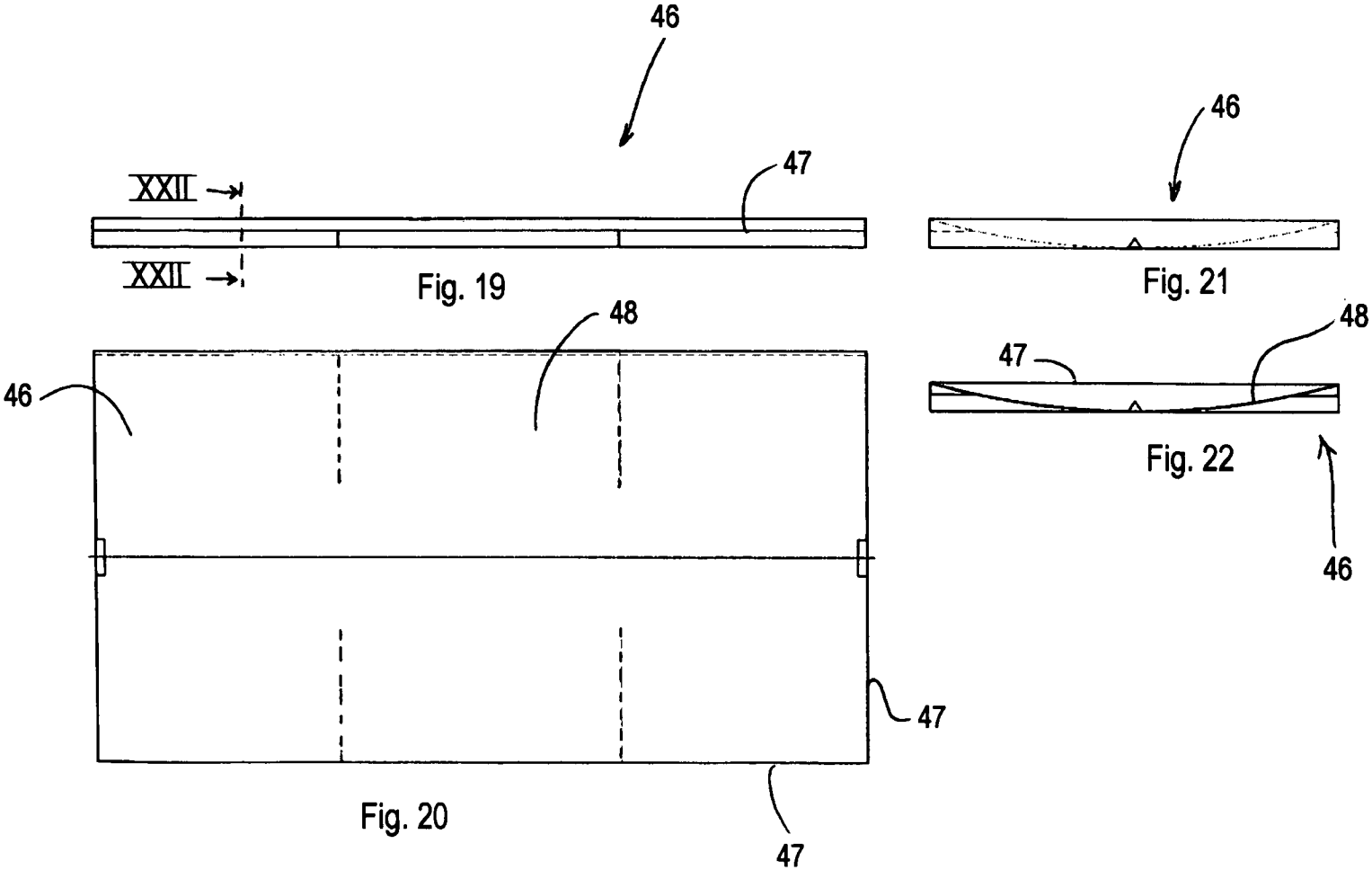
FIG. 19 is a front view of a reflecting bottom element.
FIG. 20 is a top view of the reflecting bottom element in FIG. 19.
FIG. 21 is a side view of the reflecting bottom element in FIG. 19.
FIG. 22 is a section taken along the plane XXII-XXII in FIG. 19.

As shown in FIG. 14, inside the kiln 203 a heating chamber is defined that has an upper end 43 that is open and provided with a protective net, that prevents objects falling accidentally inside the heating chamber. The latter is further bounded by insulated side walls 44, for example honeycombed walls. Inside the kiln 203 a plurality of reflecting sheet-metal elements 45 is provided, for example galvanised sheet metal, fixed to the side walls 44 but separated from the latter by a certain distance. The sheet metal elements 45 comprises side panels substantially parallel to the side walls 44 and lower panels having respective portions tilted with respect to the side walls 44. These portions are folded towards a central line section of the kiln 203.

The sheet metal elements 45 protect the side walls 44 from the infrared radiation. Between the sheet metal elements 45 and the side walls 44 cavities are defined that contribute to insulating the kiln 203 thermally. The sheet metal elements 45 also reflect the radiation emitted by the infrared lamps and direct the radiation to the section bars 61 situated on the supporting carriage 102.

Also the kiln 3 and the kiln 103 have a similar structure to the kiln 203, i.e. they are provided with side walls insulated with reflecting sheet metal and a protective net. The supporting carriage 102 comprises a thermally insulating panel 60 connected to the supporting frame 5.

The supporting carriage 102 is shaped in such a way that, when it is positioned inside the kiln 203, it bounds the heating chamber below in which the section bars 61 are heated. In other words, the supporting frame 5 defines a supporting plane for supporting the section bars 61 and simultaneously acts as a bottom element for the kiln 203.

The kiln 203 is also provided with seal elements, for example washers 63, connected to the sheet metal elements 45 arranged in a lower position. The washers 63 have the shape of flexible thin layers. When the supporting carriage 102 is positioned inside the kiln 203, the washers 63 come into contact with perimeter zones of the supporting frame 5 such as to close further the volume of the heating chamber, to limit possible dispersion of heat towards the exterior.

The apparatus 200 may comprise a lower reflector 46, better shown in FIGS. 19-22.

The lower reflector 46 comprises perimeter walls 47, that are arranged in such a way as to define a plan view of a rectangle and a shaped bottom wall 48, which is in particular concave, which, in use, reflects the infrared radiation emitted by the lamps and directs the infrared radiation to the section bars 61.

In particular, the lower reflector 46 intercepts the radiation that traverses the zones interposed between two adjacent section bars 61 and reflects the radiation upwards such that it again hits the section bars 61.

In an embodiment, the lower reflector 46 is removably connected to the supporting frame 5. In this case the lower reflector 46 can be removed from the supporting frame 5 so as to enable objects of large dimensions to be decorated that are rested directly on the resting plane. It is thus possible to decorate sheet metal the dimensions of which are such as to occupy a substantial part of the resting plane without leaving zones thereof uncovered.

Owing to the reflecting sheet metal elements 45, to the arrangement of the infrared lamps, and to the lower reflector 46, optimal distribution of temperature inside the kiln is achieved. Unlike known apparatuses, it is not necessary to provide devices for circulating the hot air that is generated inside the apparatus, nor is a hood necessary for conveying the gases that have to be evacuated from the apparatus.

In an alternative embodiment, the supporting carriage 2, disclosed with reference to FIG. 1, the first supporting carriage 18 and the second supporting carriage 21, disclosed with reference to FIG. 5, may comprise a further supporting frame 50, better shown in FIGS. 23-29. The further supporting frame 50 comprises a bottom wall 51, near which a membrane 52 is fitted, for example of silicone material. The membrane 52 is anchored to the further supporting frame 50 along a perimeter zone of the latter.

On the membrane 52 there is positioned a yielding element, such as a sponge element 53, that may comprise several superimposed layers for sponge, for example three layers.

On a perimeter portion of the further supporting frame 51 an air suction opening 54 is provided.

A closing frame 107, completely similar to the closing frame 7 disclosed with reference to FIGS. 1 to 3, is hinged on the further supporting frame 50.

During operation, on the further supporting frame 50 the objects to be positioned are decorated, which may comprise in particular shaped sheet metal 57, for example shaped sheet metal intended for the construction of doors.

In particular, the sheet metal 57 to be decorated is rested on the sponge element 53, after which the sheet metal 57 is covered with a decorating sheet 58 on which sublimable decorations are printed that have to be transferred to a first face 56 of the sheet metal 57. The closing frame 107 is moved towards the further supporting frame 50, so as to lock peripheral zones of the decorating sheet 58 against the seals 49. At this point, between the decorating sheet 58 and the membrane 52 a closed region is defined.

Figure 24:
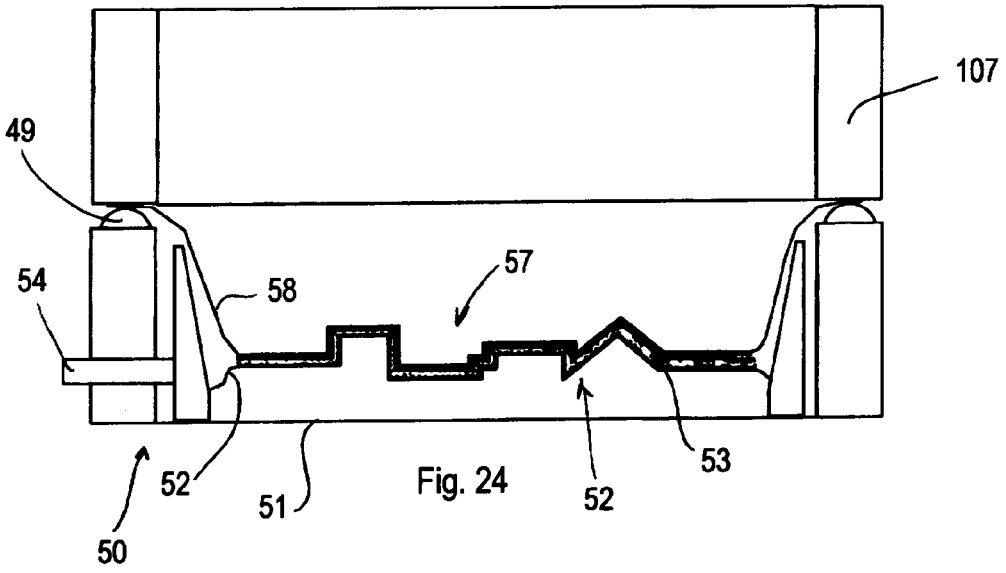
FIG. 24 is a schematic view of the portion of supporting carriage in FIG. 23 in a further operating configuration.

Through the suction opening 54 air is then sucked so as to deform the membrane 52 that pushes the decorating sheet 58 against the sheet metal 57 until it is made to adhere to the aforesaid sheet metal, as shown in FIG. 24. The further supporting frame 50 is then inserted inside the kiln to heat the sheet metal 57 and the decorating sheet 58 until sublimation of the decoration. The adhesion of the decorating sheet 58 to the sheet metal 57 can be facilitated by heat generated inside the kiln, if the decorating sheet 58 is made with a material that softens when heated.

In this way, the decorating sheet 58 adheres to the first face 56 of the sheet metal 57, following the profile thereof and generating thereupon distributed pressure forces. The membrane 52 compresses the sponge element 53 and forces the sponge element 53 to adapt to the profile of the sheet metal 57, generating on the latter further pressure forces acting on a second face 59 opposite the first face 56, these further pressure forces opposing the pressure forces generated by the decorating sheet 58. In this way the results of the forces acting on the sheet metal 57 are substantially cancelled and the risk is significantly reduced that also a very delicate piece of sheet metal will be deformed.

After a set period of time that is necessary for complete sublimation of the decorations, the sheet metal 57 can be extracted from the kiln and disengaged from the membrane 52, from the sponge element 53 and from the decorating sheet 58. It is possible to pump air between the membrane 52 and the decorating sheet 58 to facilitate the detachment thereof from the sheet metal 57.

With the aforesaid apparatuses, in addition to the section bars 61 and to the sheet metal 57, also other types of objects can be decorated such as handles, switches and small three-dimensional objects in general.

Figure 23:
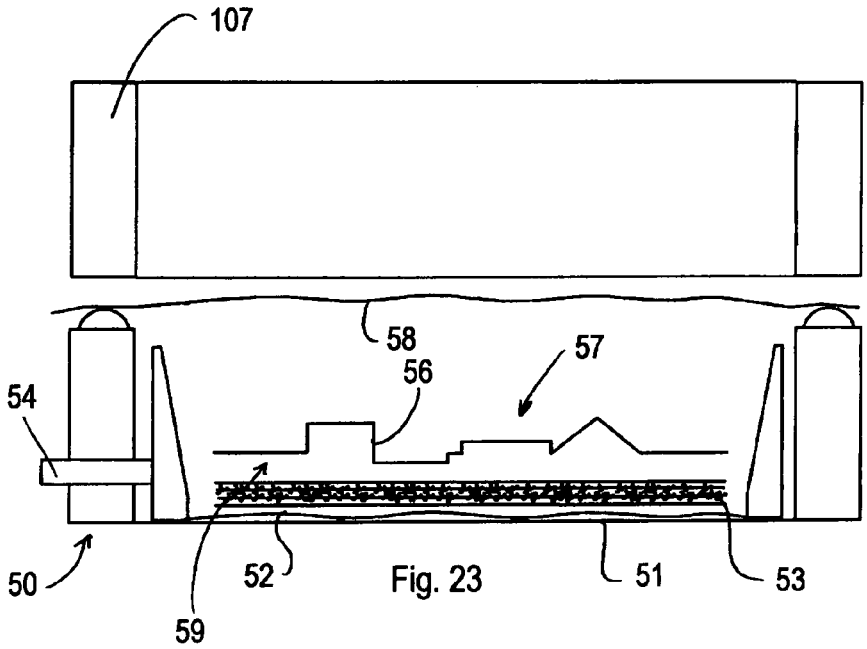
FIG. 23 is a schematic view of a portion of supporting carriage in an operating configuration.

Lastly, it should be noted that the kiln layouts shown in FIGS. 1 to 3, 5 to 7 and 12 can be used both in combination with supporting frames of the type shown in FIG. 14, i.e. which are suitable for decorating elongated elements wound in a tubular casing, and in combination with supporting frames of the type shown in FIG. 23, i.e. suitable for decorating sheet metal.

Further, also a supporting frame of the type shown in FIGS. 23 and 24 can act as a bottom wall of the kiln, as shown in FIG. 14.

The invention claimed is:

1. Apparatus for decorating objects, comprising (a) a kiln including side walls defining a heating chamber having an open bottom portion;

(b) a carriage including a support frame having an upper portion for supporting the objects and a lower portion, said carriage being movable between a first position exterior of said kiln and a second position within said kiln, said support frame forming a bottom wall of said kiln to define said heating chamber within said kiln when said carriage is in said second position;

(c) a reflecting element connected with said support frame between said upper and lower portions and including a reflecting surface that is concave with respect to the objects on said support frame upper portion for reflecting thermal radiation within said kiln directly onto said objects when said carriage is in said second position.

2. Apparatus as defined in claim 1, and further comprising a heating element arranged in an upper portion of said kiln heating chamber.

3. Apparatus according to claim 1, wherein said reflecting element is removably mounted on said carriage.

4. Apparatus according to claim 2, wherein said heating element comprises a lamp device that is able to emit infrared radiation.

5. Apparatus according to claim 4, wherein said lamp device emits a quantity of infrared radiation in peripheral zones of said support frame upper portion that is greater than central zones of said support frame upper portion.

6. Apparatus according to claim 5, wherein said lamp device comprises first lamps positioned along a perimeter of said support frame upper portion and second lamps positioned inside said perimeter, said first lamps having greater power than said second lamps.

7. Apparatus according to claim 5, wherein said kiln side walls include reflecting sheet-metal for protecting said side walls from said infrared radiation, and for reflecting said infrared radiation on said objects.

8. Apparatus according to claim 7, wherein said reflecting sheet-metal is spaced from said side walls such that between said side walls and said reflecting sheet-metal there is defined an air cavity.

9. Apparatus for decorating objects, comprising (a) a kiln including side walls defining a heating chamber having an open bottom portion;

(b) a carriage including a support frame having an upper portion for supporting the objects, said carriage being movable between a first position exterior of said kiln and a second position within said kiln, said support frame forming a bottom wall of said kiln to define said heating chamber within said kiln when said carriage is in said second position;

(c) a plurality of seal elements connected with said side walls for engaging said support frame when said carriage in said second position; and (d) a reflecting element connected with said support frame between said upper and lower portions and including a reflecting surface that is concave with respect to the objects on said support frame upper portion for reflecting thermal radiation within said kiln directly onto said objects when said carriage is in said second position.

* * * * *